US010637202B2

(12) United States Patent
Mitchell

(10) Patent No.: US 10,637,202 B2
(45) Date of Patent: Apr. 28, 2020

(54) CONNECTOR DEMATE TOOLS

(71) Applicant: Goodrich Corporation, Charlotte, NC (US)

(72) Inventor: Michael D. Mitchell, Albuquerque, NM (US)

(73) Assignee: Goodrich Corporation, Charlotte, NC (US)

( * ) Notice: Subject to any disclaimer, the term of this patent is extended or adjusted under 35 U.S.C. 154(b) by 324 days.

(21) Appl. No.: 15/499,182

(22) Filed: Apr. 27, 2017

(65) Prior Publication Data

US 2018/0316153 A1 Nov. 1, 2018

(51) Int. Cl.
*H01R 43/26* (2006.01)
*B25B 27/00* (2006.01)

(52) U.S. Cl.
CPC ..... *H01R 43/26* (2013.01); *B25B 27/00* (2013.01)

(58) Field of Classification Search
CPC ..... H05K 13/0408; H05K 13/0486; H05K 13/0491; B25B 27/00; H01R 43/26
See application file for complete search history.

(56) References Cited

U.S. PATENT DOCUMENTS 3,443,297 A * 5/1969 Lusby, Jr. ..... H05K 13/0491 29/764
3,453,586 A * 7/1969 Brendlen, Jr. ... H01R 13/62905 439/153
3,696,492 A * 10/1972 Baillard ..... H05K 7/1415 29/758
4,468,858 A * 9/1984 Gulberg ..... H01R 43/26 29/239
4,583,287 A * 4/1986 McDevitt ..... H05K 13/0491 29/278
4,583,288 A * 4/1986 Young ..... H05K 13/0408 29/741
4,597,174 A * 7/1986 Sevigny ..... H05K 13/0486 29/741
4,868,975 A * 9/1989 Zaremba ..... H05K 13/0491 29/741
5,473,816 A * 12/1995 Harden, Jr. ..... B25B 27/02 29/239
10,195,726 B2 * 2/2019 Truong ..... B25B 27/02

* cited by examiner

*Primary Examiner* — Carl J Arbes
(74) *Attorney, Agent, or Firm* — Locke Lord LLP; Scott D. Wofsy; Joshua L. Jones

(57) ABSTRACT

A tool for demating multi-pin connectors includes a first fork including an inner fork member and an outer fork member operatively connected for relative movement parallel to a longitudinal fork axis. A second fork is spaced apart from the first fork wherein the second fork includes an inner fork member and an outer fork member operatively connected for relative movement parallel to the longitudinal fork axis. A handle connects the first fork to the second fork. The handle includes an outer handle member fixedly connecting the outer fork members of the first and second forks, and the handle includes an inner handle member fixedly connecting the inner fork members of the first and second forks. Relative movement of the inner and outer handle members causes relative movement of the inner and outer fork members of the first and second forks for demating multi-pin electrical connectors from sockets.

10 Claims, 3 Drawing Sheets

CONNECTOR DEMATE TOOLS

STATEMENT REGARDING FEDERALLY SPONSORED RESEARCH OR DEVELOPMENT

This invention was made with government support under Contract No. NAS5-02200 awarded by an NASA. The government has certain rights in the invention.

BACKGROUND OF THE INVENTION

1. Field of the Invention

The present disclosure relates to connectors such as used in multi-pin electrical connectors, and more particularly to demating or disconnecting multi-pin electrical connectors.

2. Description of Related Art

Large, multi-pin electrical connectors, such as those having fifty or more pins, are difficult to demate from their sockets. Extensive force is typically required when removing the connectors by hand, and it is possible to damage individual connector pins during the process. This damage can render the connector unusable.

The conventional techniques have been considered satisfactory for their intended purpose. However, there is an ever present need for improved ways of demating connectors. This disclosure provides a solution for this problem.

SUMMARY OF THE INVENTION

A tool for demating multi-pin connectors includes a first fork including an inner fork member and an outer fork member operatively connected for relative movement parallel to a longitudinal fork axis. A second fork is spaced apart from the first fork wherein the second fork includes an inner fork member and an outer fork member operatively connected for relative movement parallel to the longitudinal fork axis. A handle connects the first fork to the second fork. The handle includes an outer handle member fixedly connecting the outer fork members of the first and second forks, and the handle includes an inner handle member fixedly connecting the inner fork members of the first and second forks. Relative movement of the inner and outer handle members causes relative movement of the inner and outer fork members of the first and second forks for demating multi-pin electrical connectors from sockets.

The longitudinal fork axis is equidistant from the first and second forks. The inner fork members of the first and second forks face inwardly toward one another and toward the longitudinal fork axis. The outer fork members of the first and second forks face outwardly away from the longitudinal fork axis. Each of the inner fork members includes a gripping flange extending inwardly toward the longitudinal fork axis at an end of the inner fork members opposite the handle. The gripping flanges are configured to grip a multi-pin connector for demating. Each gripping flange includes an inwardly pointed wedge for facilitating engagement of the gripping flanges to a multi-pin connector. Each gripping flange includes an inwardly opening channel for clearing a fastener used to secure a multi-pin connector to a socket.

The inner handle member includes a pair of parallel prongs extending therefrom. The outer handle member includes a pair of parallel prong receptacles receiving the pair of parallel prongs for maintaining alignment of the inner and outer handle members during relative movement of the inner and outer handle members. A biasing member is seated in each of the prong receptacles to bias the inner and outer handle members away from one another. The biasing member and the inner and outer fork members are configured so that the biasing member biases the inner fork members to extend away from the handle beyond ends of the outer fork members.

Each inner fork member includes a longitudinally extending slot. Each outer fork member includes a pair of fasteners extending through the slot to maintain axially aligned relative motion of the inner fork members relative to the outer fork members. The first and second forks are flexible for closing a gap between ends of the first and second forks opposite the handle to squeeze a multi-pin connector between the first and second forks.

A method of demating a multi-pin connector from a socket includes spanning a multi-pin connector mated in a socket with spaced apart forks of a demate tool, securing inner fork members of the spaced apart forks to the multi-pin connector, securing outer fork members of the spaced apart forks to a surface stationary relative to the socket, and moving the inner fork members away from the socket while maintaining the outer fork members stationary relative to the socket to pull the multi-pin connector out of the socket.

The method can include squeezing the first and second forks together to bring the inner fork members into engagement with the multi-pin connector prior to moving the inner fork members away from the socket. Securing inner fork members to the multi-pin connector includes engaging inwardly extending gripping flanges of the inner fork members to the multi-pin connector. Engaging inwardly extending gripping flanges of the inner fork members includes clearing fasteners used to secure the multi-pin connector to the socket with inwardly opening channels in the gripping flanges.

A cable connected to the multi-pin connector can be de-energized prior to spanning the multi-pin connector. The cable can be positioned to be clear of movement of the forks prior to pulling the multi-pin connector out of the socket. Any fasteners securing the multi-pin connector to the socket can be released prior to spanning the multi-pin connector.

Securing the inner fork members to the multi-pin connector can include initially pressing the inner fork members against the surface stationary relative to the socket. The method can include squeezing the forks together and moving the inner and outer fork members relative to one another while maintaining the outer fork members pressed against the surface stationary relative to the socket. The multi-pin connector is removed by moving the inner fork members without pulling the entire tool away from the socket and without rocking the entire tool back and forth.

A tool for demating multi-pin connectors includes a first fork having a first tine and a second tine connected to each other by a first yoke and a second fork having a third tine and a fourth tine connected to each other by a second yoke. The second fork is movably engaged with the first fork such moving the first yoke toward the second yoke causes an end of the first tine to move away from an end of the third tine and an end of the second tine to move away from an end of the fourth tine. The first tine and the second tine are sized and configured to engage a multi-pin connector.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
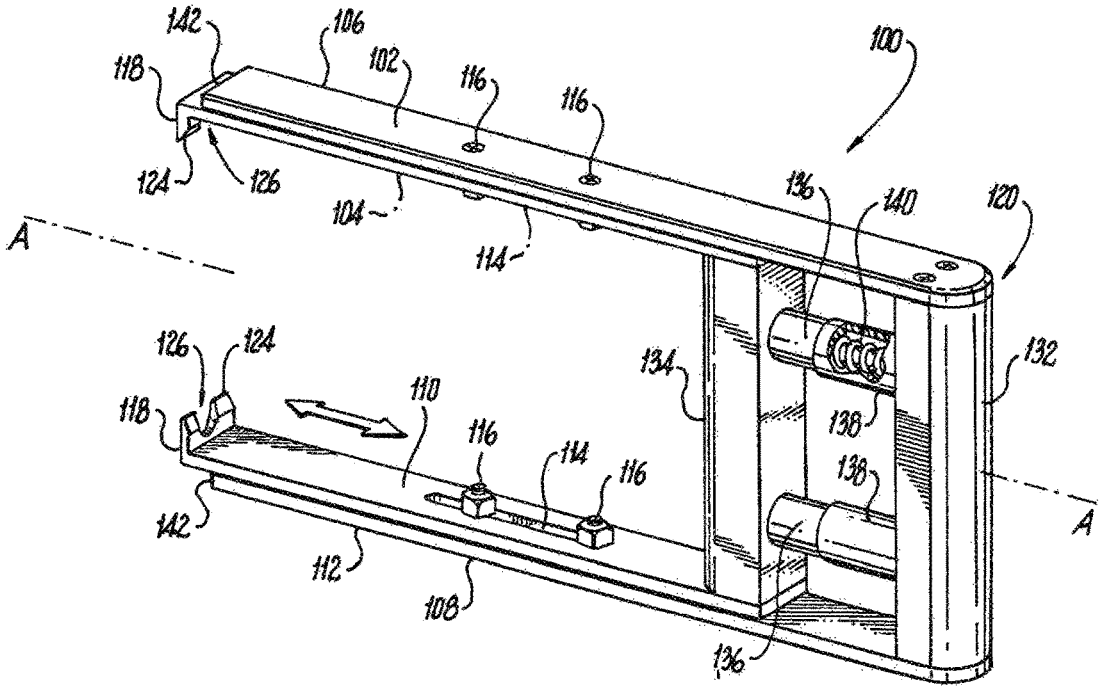
FIG. 1 is a perspective view of an exemplary embodiment of a tool constructed in accordance with the present disclosure, showing the handle and forks.

Reference will now be made to the drawings wherein like reference numerals identify similar structural features or aspects of the subject disclosure. For purposes of explanation and illustration, and not limitation, a partial view of an exemplary embodiment of a tool in accordance with the disclosure is shown in FIG. 1 and is designated generally by reference character 100. Other embodiments of tools in accordance with the disclosure, or aspects thereof, are provided in FIGS. 2-5, as will be described. The systems and methods described herein can be used to demate multi-pin connectors from sockets.

The tool 100 for demating multi-pin connectors includes a first fork 102 including an inner fork member 104 and an outer fork member 106 operatively connected for relative movement parallel to a longitudinal fork axis A, i.e. in the direction of the large arrow in FIG. 1. A second fork 108 is spaced apart from the first fork 102. The second fork 108 similarly includes an inner fork member 110 and an outer fork member 112 operatively connected for relative movement parallel to the longitudinal fork axis A. Each inner fork member 104 and 110 includes a longitudinally extending slot 114. Each outer fork member 102 and 112 includes a pair of fasteners 116 extending through the slot 114 to maintain axially aligned relative motion of the inner fork members 104 and 110 relative to the outer fork members 106 and 112.

The longitudinal fork axis A is equidistant from the first and second forks 102 and 108. The inner fork members 104 and 110 face inwardly toward one another and toward the longitudinal fork axis A. The outer fork members 106 and 112 face outwardly away from the longitudinal fork axis A.

Figure 2:
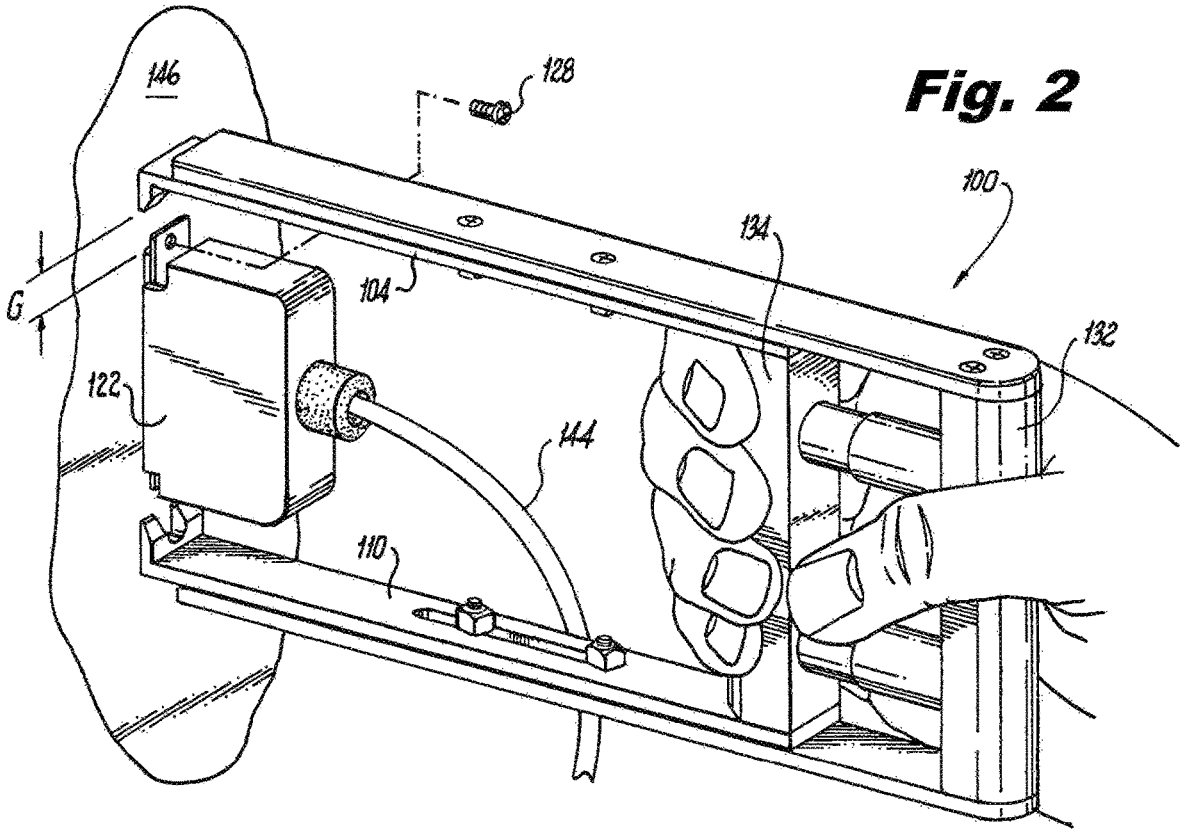
FIG. 2 is a perspective view of the tool of FIG. 1, showing a multi-pin connector connected to a socket wherein the tool can be used for demating the multi-pin connector.
Figure 3:
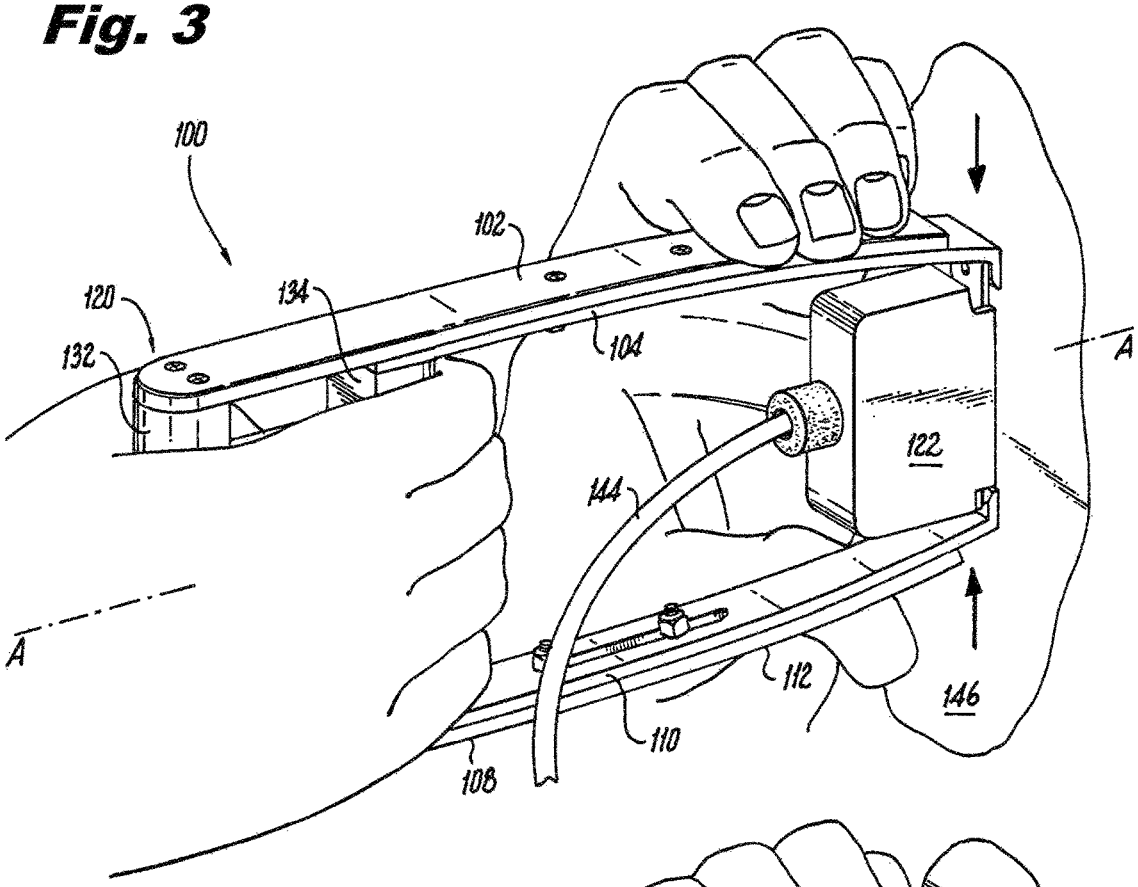
FIG. 3 is a perspective view of the tool of FIG. 1, showing the forks being squeezed together to engage the multi-pin connector.
Figure 4:
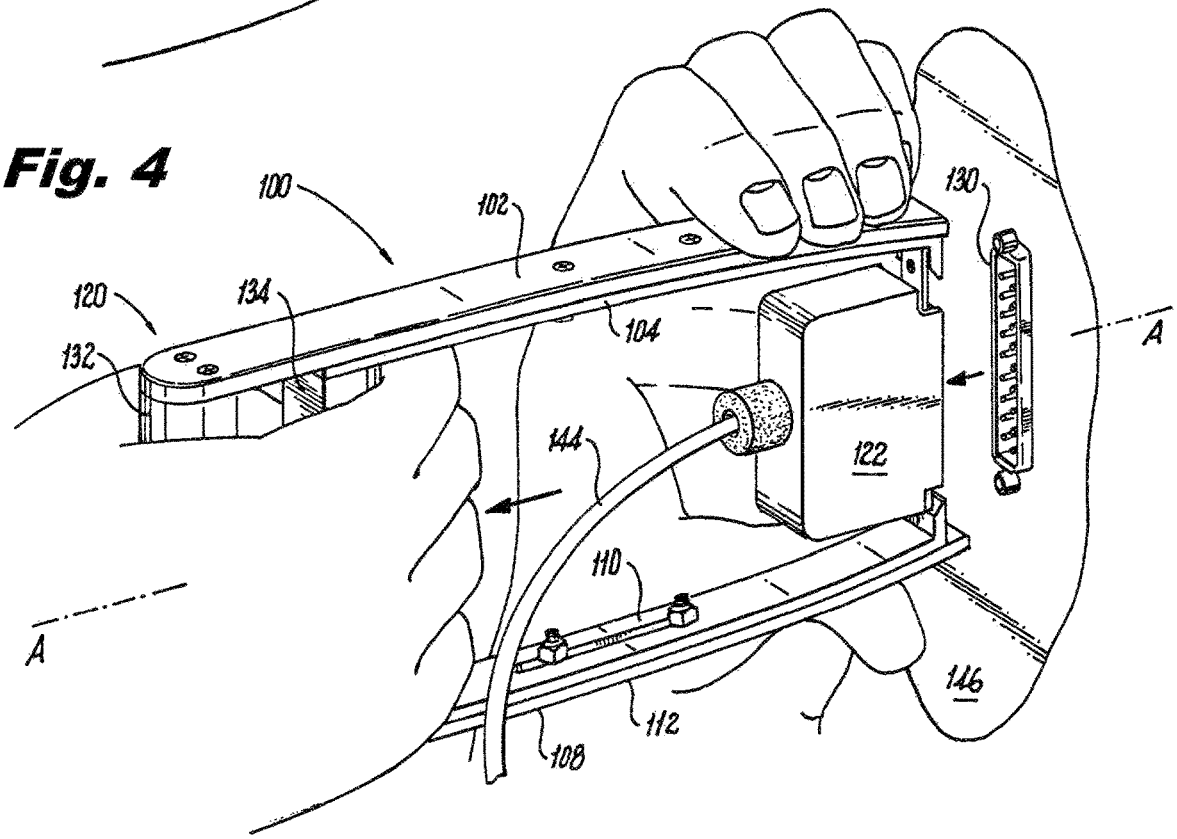
FIG. 4 is a side elevation view of the tool of FIG. 1, showing the inner and outer fork members moved relative to one another, demating the multi-pin connector from the socket.
Figure 5:
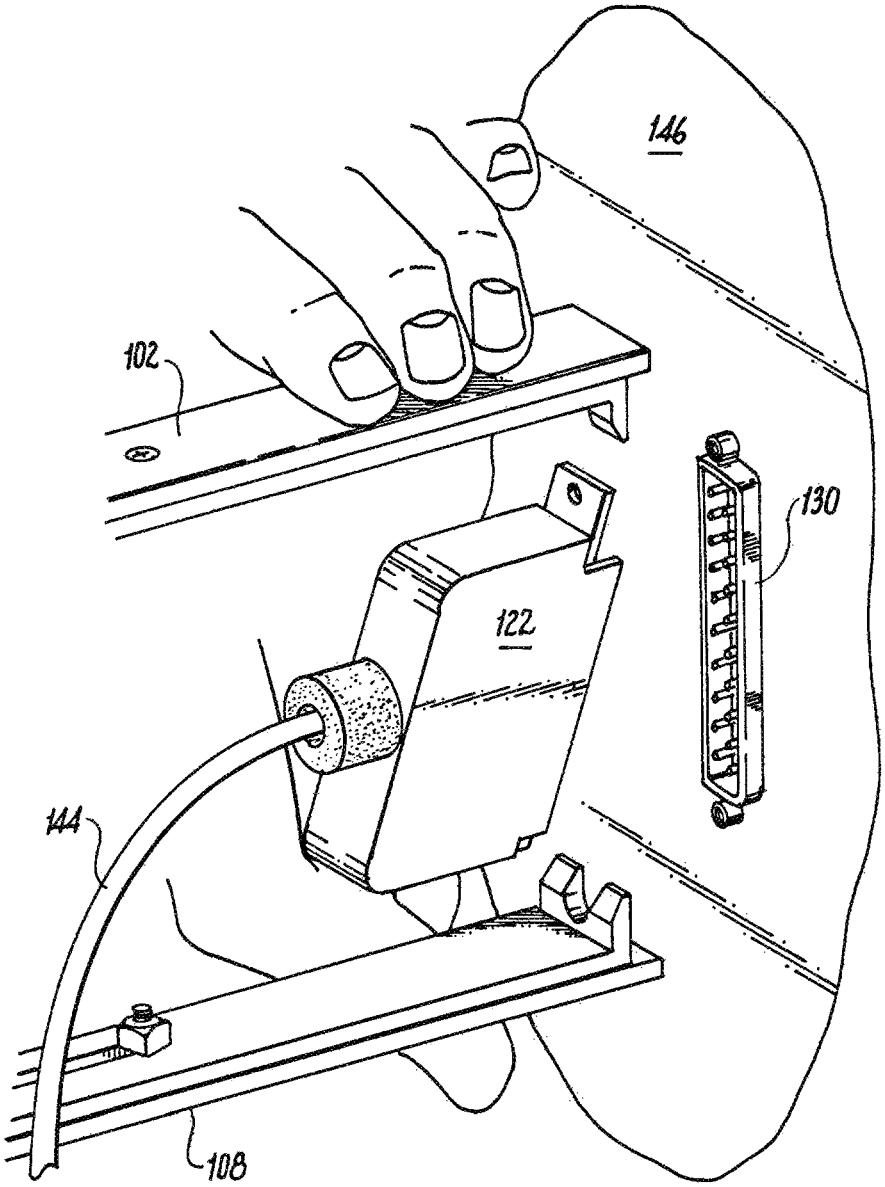
FIG. 5 is a perspective view of the tool of FIG. 1, showing removal of the multi-pin connector from the tool after demating from the socket.

Each of the inner fork members 104 and 110 includes a gripping flange 118 extending inwardly toward the longitudinal fork axis A at an end of the inner fork members opposite the handle 120. The gripping flanges 118 are configured to grip a multi-pin connector 122, as shown in FIGS. 2-4 for demating. Each gripping flange 118 includes an inwardly pointed wedge 124 for facilitating engagement of the gripping flanges 118 to the multi-pin connector 122. Each gripping flange 118 also includes an inwardly opening channel 126 for clearing a fastener 128 used to secure the multi-pin connector 122 to a socket 130 as shown in FIGS. 2 and 5.

The handle 120 connects the first fork 102 to the second fork 108. The handle 120 includes an outer handle member 132 fixedly connecting the outer fork members 106 and 112. The handle 120 also includes an inner handle member 134 fixedly connecting the inner fork members 104 and 110. Relative movement of the inner and outer handle members 134 and 132 causes movement of the inner fork members 104 and 110 relative to the outer fork members 106 and 112 for demating multi-pin electrical connectors from sockets.

The inner handle member 134 includes a pair of parallel prongs 136 extending therefrom. The outer handle member 132 includes a pair of parallel prong receptacles 138 receiving the pair of parallel prongs 136 for maintaining alignment of the inner and outer handle members 134 and 132 during relative movement of the inner and outer handle members 134 and 132. A biasing member 140 is seated in each of the prong receptacles 138 to bias the inner and outer handle members 134 and 132 away from one another to place the tool 100 in the first position shown in FIG. 1. This biasing can be overcome by squeezing the inner and outer handle members 134 and 132 toward one another to place the tool 100 in the second position shown in FIG. 4. The biasing members 140 and the inner and outer fork members 104, 110, 106, and 112 are configured so that the biasing member 140 biases the inner fork members 104 and 110 to extend away from the handle beyond ends 142 of the outer fork members 106 and 112 to facilitate the initial engagement of the tool 100 when demating a multi-pin connector as described below. The first and second forks 102 and 108 are flexible for closing a gap G between ends of the first and second forks opposite the handle 120 to squeeze a multi-pin connector 122 between the first and second forks 102 and 108. More specifically, the gap G is shown in FIG. 2 as being between one of the forks 102 and the multi-pin connector 122 when the other fork 108 is engaged to the multi-pin connector. This flexibility accommodates a variety of sizes of multi-pin connectors.

With reference now to FIGS. 2-5, a method of demating a multi-pin connector, e.g. multi-pin connector 122, from a socket, e.g., socket 130, is described. A cable 144 connected to the multi-pin connector 122 can be de-energized prior to spanning the multi-pin connector 122 with the forks 102 and 108. The cable 144 can be positioned to be clear of movement of the forks 102 and 108 prior to pulling the multi-pin connector 122 out of the socket 130, as shown in FIG. 2. Any fasteners 128 securing the multi-pin connector 122 to the socket 130 can be released prior to spanning the multi-pin connector 122.

The multi-pin connector 122 mated in the socket 130 can then be spanned with the spaced apart forks 102 and 108 of the demate tool 100. The inner fork members 104 and 110 can then be secured to the multi-pin connector 122, which can include initially securing the inner fork members 104 and 110 against a surface 146 that is stationary relative to the socket 130 by pressing the inner fork members 104 and 110 against the surface 146. The method can include squeezing the forks 102 and 108 together, as indicated by the large arrows in FIG. 3, to secure the inwardly extending gripping flanges 118 (shown in FIG. 1) into engagement with the multi-pin connector 122. The channels 126, shown in FIG. 1, allow gripping flanges 118 to clear any fasteners or portions thereof used to secure the multi-pin connector 122 to the socket 130

With reference to FIG. 4, squeezing inner and outer handle members 134 and 132 together moves the inner fork members 104 and 110 relative to the outer fork members 106 and 112 in the direction indicated by the large arrow in FIG.

1, while maintaining the outer fork members 106 and 112 pressed against the surface 146 that is stationary relative to the socket 130. This moves the inner fork members 104 and 110 away from the socket 130 while maintaining the outer fork members 106 and 112 stationary relative to the socket 130 to pull the multi-pin connector 122 out of the socket 130. This motion is accomplished without pulling the entire tool 100 away from the socket and without rocking the entire tool 100 back and forth. Finally, as shown in FIG. 5, the multi-pin connector 122 can be released from the tool 100 by relaxing forks 102 and 108 and handle 120.

A tool, e.g., tool 100, for demating multi-pin connectors includes a first two-tined fork having a first tine, e.g., inner fork member 104, and a second tine, e.g., inner fork member 110, connected to each other by a first yoke, e.g., inner handle member 134, and a two-tined fork second fork having a third tine, e.g., outer fork member 106, and a fourth tine, e.g., outer fork member 112, connected to each other by a second yoke, e.g., outer handle member 132. The second fork is movably engaged with the first fork such moving the first yoke toward the second yoke causes an end of the first tine to move away from an end of the third tine and an end of the second tine to move away from an end of the fourth tine. The first tine and the second tine are sized and configured to engage a multi-pin connector, e.g., multi-pin connector 122.

The methods and systems of the present disclosure, as described above and shown in the drawings, provide for demating multi-pin connectors from sockets with superior properties including improved maintenance of pin alignment during demating to reduce and prevent damaging the pins. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A tool for demating multi-pin connectors comprising:

a first fork including an inner fork member and an outer fork member operatively connected for relative movement parallel to a longitudinal fork axis;

a second fork spaced apart from the first fork wherein the second fork includes an inner fork member and an outer fork member operatively connected for relative movement parallel to the longitudinal fork axis; and a handle connecting the first fork to the second fork wherein the handle includes an outer handle member fixedly connecting the outer fork members of the first and second forks, and wherein the handle includes an inner handle member fixedly connecting the inner fork members of the first and second forks so that relative movement of the inner and outer handle members causes relative movement of the inner and outer fork members of the first and second forks for demating multi-pin electrical connectors from sockets.

2. The tool as recited in claim 1, wherein the longitudinal fork axis is equidistant from the first and second forks, wherein the inner fork members of the first and second forks face inwardly toward one another and toward the longitudinal fork axis, and wherein the outer fork members of the first and second forks face outwardly away from the longitudinal fork axis.

3. The tool as recited in claim 2, wherein each of the inner fork members includes a gripping flange extending inwardly toward the longitudinal fork axis at an end of the inner fork members opposite the handle, the gripping flanges being configured to grip a multi-pin connector for demating.

4. The tool as recited in claim 3, wherein each gripping flange includes an inwardly pointed wedge for facilitating engagement of the gripping flanges to a multi-pin connector.

5. The tool as recited in claim 3, wherein each gripping flange includes an inwardly opening channel for clearing a fastener used to secure a multi-pin connector to a socket.

6. The tool as recited in claim 1, wherein the inner handle member includes a pair of parallel prongs extending therefrom, and wherein the outer handle member includes a pair of parallel prong receptacles receiving the pair of parallel prongs for maintaining alignment of the inner and outer handle members during relative movement of the inner and outer handle members.

7. The tool as recited in claim 1, wherein a biasing member is seated in each of the prong receptacles to bias the inner and outer handle members away from one another.

8. The tool as recited in claim 1, wherein the biasing member and the inner and outer fork members are configured so that the biasing member biases the inner fork members to extend away from the handle beyond ends of the outer fork members.

9. The tool as recited in claim 1, wherein each inner fork member includes a longitudinally extending slot, and wherein each outer fork member includes a pair of fasteners extending through the slot to maintain axially aligned relative motion of the inner fork members relative to the outer fork members.

10. The tool as recited in claim 1, wherein the first and second forks are flexible for closing a gap between ends of the first and second forks opposite the handle to squeeze a multi-pin connector between the first and second forks.

* * * * *